US006209143B1

(12) United States Patent
Hancock

(10) Patent No.: US 6,209,143 B1
(45) Date of Patent: Apr. 3, 2001

(54) HIGHLY-VENTILATED CROTCH PANEL FOR UNDERGARMENTS

(75) Inventor: Shèron B. Hancock, Romulus, MI (US)

(73) Assignee: Special Needs Incorporated, Wayne, MI (US)

( * ) Notice: Subject to any disclaimer, the term of this patent is extended or adjusted under 35 U.S.C. 154(b) by 0 days.

(21) Appl. No.: 09/112,040

(22) Filed: Jul. 8, 1998

(51) Int. Cl.[7] ..... A41B 9/00
(52) U.S. Cl. ..... 2/406; 2/408
(58) Field of Search ..... D02/712, 700, D02/702, 710; 2/409, 400, 401, 408, 406, 78.1; D24/125; 66/170, 171; 450/30

(56) References Cited

U.S. PATENT DOCUMENTS

D. 352,577 * 11/1994 Shover ..... D30/145
3,486,507 * 12/1969 Bregenzer et al. ..... 2/408

FOREIGN PATENT DOCUMENTS

2085710 * 5/1982 (GB) .

* cited by examiner

*Primary Examiner*—John J. Calvert
*Assistant Examiner*—Alissa L. Hoey
(74) *Attorney, Agent, or Firm*—Rohm & Monsanto, PLC

(57) ABSTRACT

Undergarments, such as panties and pantyhose, having a highly-ventilated crotch panel which has one or more apertures therein in order to provide adequate light and ventilation to prevent the conditions that are favorable to vaginitis or other infections. The openness of the crotch panel enhances air flow, allows for the dissipation of heat and moisture, and yet, is not so large as to cause binding, discomfort, or an uncomfortable feeling of exposure to the wearer. In some embodiments, moisture is further absorbed or dissipated around the aperture(s) by a surrounding trim, such as elasticized lace, which also provides the illusion of covering to the wearer. In other embodiments, the aperture (s) have a modesty panel which is a single layer of an open-weave knit mesh.

18 Claims, 5 Drawing Sheets

HIGHLY-VENTILATED CROTCH PANEL FOR UNDERGARMENTS

BACKGROUND OF THE INVENTION

1. Field of the Invention

This invention relates generally to women's undergarments or lingerie, and more particularly to panties and pantyhose having a highly-ventilated crotch to promote feminine health maintenance.

2. Background of the Prior Art

Vaginitis and yeast infections are common ailments suffered by many women. The uncomfortable, common symptoms include burning, itching, and vaginal discharge. These symptoms are not always present. In fact, vaginitis can occur in as many as four out of ten women without symptom. Nevertheless, the presence of infection is harmful and potentially damaging to the health of the victim. For this reason, the prevention of infection, such as by avoiding conditions which are favorable to the growth of the microbes responsible for these infections, is warranted. The conditions which create and encourage microbial growth include dampness for prolonged periods of time, and the absence of light and air. However, since women can easily perspire during the course of a busy day, causing their panties to become damp and remain that way, creation of these conditions is a widespread problem.

The advice given by health care professionals for avoiding these types of infections has been consistent: avoid wearing wet clothing or bathing suits, or sweaty exercise clothing, for lengthy periods of time; avoid wearing tight fitting clothing which increases moisture and holds in heat to create a favorable environment for vaginitis; and avoid panties made of nylon or other synthetics which retain heat and moisture.

Suggestions for mitigating against the conditions that are favorable to the growth of the microbes include wearing panties or pantyhose with cotton crotch panels. While cotton is absorbent, it nevertheless will retain moisture within its fibers. Some physicians recommend against wearing pantyhose, and even panties. However, most women find the alternative to pantyhose, i.e., a girdle or garter belt and stockings, to be uncomfortable and inconvenient. Further, wearing no panties, or crotchless panties, particularly in the work or office environment is uncomfortable for most women. There is, therefore, a need in the art for panties or pantyhose which provide adequate ventilation to prevent the conditions that are favorable to the growth of infection-producing microbes yet which does not leave the women feeling excessively exposed.

Many manufacturers utilize cotton fabric for the crotch of pantyhose. Others utilize crotch panels having a somewhat open weave. However, most of the commercially available crotch assemblies have an inner cotton liner with an outer shell, or layer, of thermoplastic yarn. The cotton, which is moisture absorbent, draws moisture away from the body by defusing it throughout the crotch area. However, the outer shell, which may be nylon, nylon-Lycra, spandex, or other synthetic material, retains heat and moisture. As a result, the outer shell, which may be close knit and tight-fitting, restricts air circulation and prevents the moisture from being evaporated, thereby mitigating against the beneficial effects of the inner cotton liner. There is therefore, a need in the art for an improved crotch panel for panties and pantyhose which ventilates and permits moisture to be evaporated freely.

It is, therefore, an object of this invention to provide undergarments, such as panties or panty hose, having a highly-ventilated crotch panel which promotes feminine health and hygiene by providing a sufficient amount of light and ventilation to discourage the build-up of heat and humidity.

It is another object of this invention to provide panties and pantyhose having a highly-ventilated crotch panel that provides a sufficient amount of light and ventilation to eliminate or lessen vaginal infections by preventing the conditions favorable to the growth of microbes responsible for such infections.

It is also an object of this invention to provide panties and pantyhose that provide preventive health maintenance to women who are subject to chronic vaginal infections.

It is a still further object of this invention to provide panties and pantyhose having a highly-ventilated crotch panel to promote health and hygiene, while providing a sense of beauty and sensuality to the wearer.

It is yet another object of this invention to provide panties and pantyhose having a highly-ventilated crotch panel that are comfortable to wear in an everyday or workday setting.

SUMMARY OF THE INVENTION

The foregoing and other objects are achieved by this invention which is undergarment, such as panties, pantyhose, girdles, leggings, leotards or tights, that have a panty portion having a highly-ventilated crotch panel which has one or more apertures extending completely through the crotch panel in order to provide adequate light and ventilation to prevent the conditions that are favorable to vaginitis or other infections. The openness of the crotch panel should enhance air flow, allow for the dissipation of heat and moisture, and yet, not be so large as to cause binding, discomfort, or an uncomfortable feeling of exposure to the wearer.

In a typical embodiment of the invention, the panty portion has a first section, which, depending upon the construction of the undergarment, may be a front section for covering the abdomen or a right or left side section, and a second section which is the converse of the first section, or a back section for covering the buttocks or the opposite side section. The aforementioned first and second sections of the panty portion, and a crotch panel, are conventionally joined to define a waist opening and two leg openings with a crotch panel intermediate the leg openings. The waist opening is typically terminated in a waistband, which may be elasticized and, in a panty embodiment, the leg openings are typically elasticized to ensure a snug fit. In a pantyhose embodiment, of course, the leg openings have integrally attached thereto leg and feet coverings.

In accordance with the principles of the invention, the crotch panel, in most fully-constructed embodiments, has a main body portion, which may be conventionally shaped, e.g., like an hourglass, diamond, or an ellipsis, and has at least one aperture extending therethrough, which is dimensioned to permit the free flow of air and is situated so as to overlie the areas of the anatomy where ventilation and light would have the most beneficial application. Typically, in the case of one aperture, the aperture is centrally located.

While the description herein is phrased in terms of a "crotch panel," it is to be understood that the crotch panel may comprise a separate element which is joined to the first and second sections by seams or it may be integrally knit. Thus, in some embodiments, the first and section sections, as well as the crotch panel, are integrally knit. In other embodiments, the front section and back section may be shaped to form, either alone or in combination, the portion which is denoted herein as the "crotch panel."

In a preferred embodiment of the invention, there is no inner or outer shell, or liner, on the crotch panel so that the aperture(s) or open work extends completely through the crotch panel. As used herein the term "open work" refers to one or more apertures in a cotton crotch panel which are bound, in some manner, so as to prevent fraying. In these preferred embodiments, moisture is absorbed or dissipated around the open work, as described below, by the surrounding material comprising the crotch panel and, in some embodiments, by a decorative trim, such as lace.

In a particularly preferred embodiment, a single-layer water-absorbent crotch panel for an undergarment has open work therein of dimensions not exceeding more than about one-third to one-half of the width-wise or lengthwise dimensions of the crotch panel. The water-absorbent crotch panel may be woven or mesh-knit cotton or other hydrophilic material. In certain preferred embodiments, the crotch panel is an open-weave mesh knit, preferably of cotton or a cotton blend, having mesh openings with a diameter on the order of about ⅛".

While the description provided herein is directed to the use of cotton or cotton blends in the crotch panel, it is to be understood that other natural fibers, such as linen or silk, or non-thermoplastic, hydrophilic synthetics which are moisture-absorbing, could be used in the practice of the invention. The crotch panel preferably comprises a single layer of absorbent material. However, it is to be understood that the main body portion of the crotch panel can comprise more than one layer of material provided the open work extends completely through the layers.

In a preferred embodiment, the aperture is a circular hole centrally located in a water-absorbent crotch panel, and having a diameter of between one third and one half of the central portion of the main body portion of the crotch panel. In a particularly preferred embodiment, the aperture is surrounded with a soft, elastic lace of cotton, nylon, or a cotton-nylon blend to prevent binding. In addition, the lace absorbs moisture, provides the illusion of covering to prevent the feeling of exposure, and is an attractive decoration to provide a sense of beauty and sensuality. In other embodiments, the apertures are bound by overstitching with thread or by finishing with bias binding or the like. In all embodiments, however, the material surrounding, or binding, the apertures aids in drawing secretions away from the body and defusing them outward to assist in evaporation. This is a significant improvement over wearing no panties, or crotchless panties.

In an alternative preferred embodiment, the crotch panel has a plurality of large diameter apertures. As used herein, the term "large diameter" refers to openings having dimensions that are greatly in excess of the dimensions of the openings in conventional woven or open-weave knit mesh. As contemplated herein, the large diameter apertures have dimensions which, in any direction, do not exceed cumulatively more than one half of the dimension of the crotch panel in that direction. This limitation provides structural integrity to the crotch panel and prevents the wearer from having the uncomfortable feeling of too much exposure.

Of course, the aperture, or apertures, may be in any shape or form, such as oval, square, or diamond. If the aperture is elongated, its lengthwise dimension should not exceed more than about one third to one half of the lengthwise dimension of the crotch panel.

In a still further embodiment of the invention, the open work is covered with a modesty panel which may be a single-layer open weave mesh or a thin, lightweight loosely woven cotton.

BRIEF DESCRIPTION OF THE DRAWING

Comprehension of the invention is facilitated by reading the following detailed description, in conjunction with the annexed drawing, in which.

DETAILED DESCRIPTION

Figure 1:
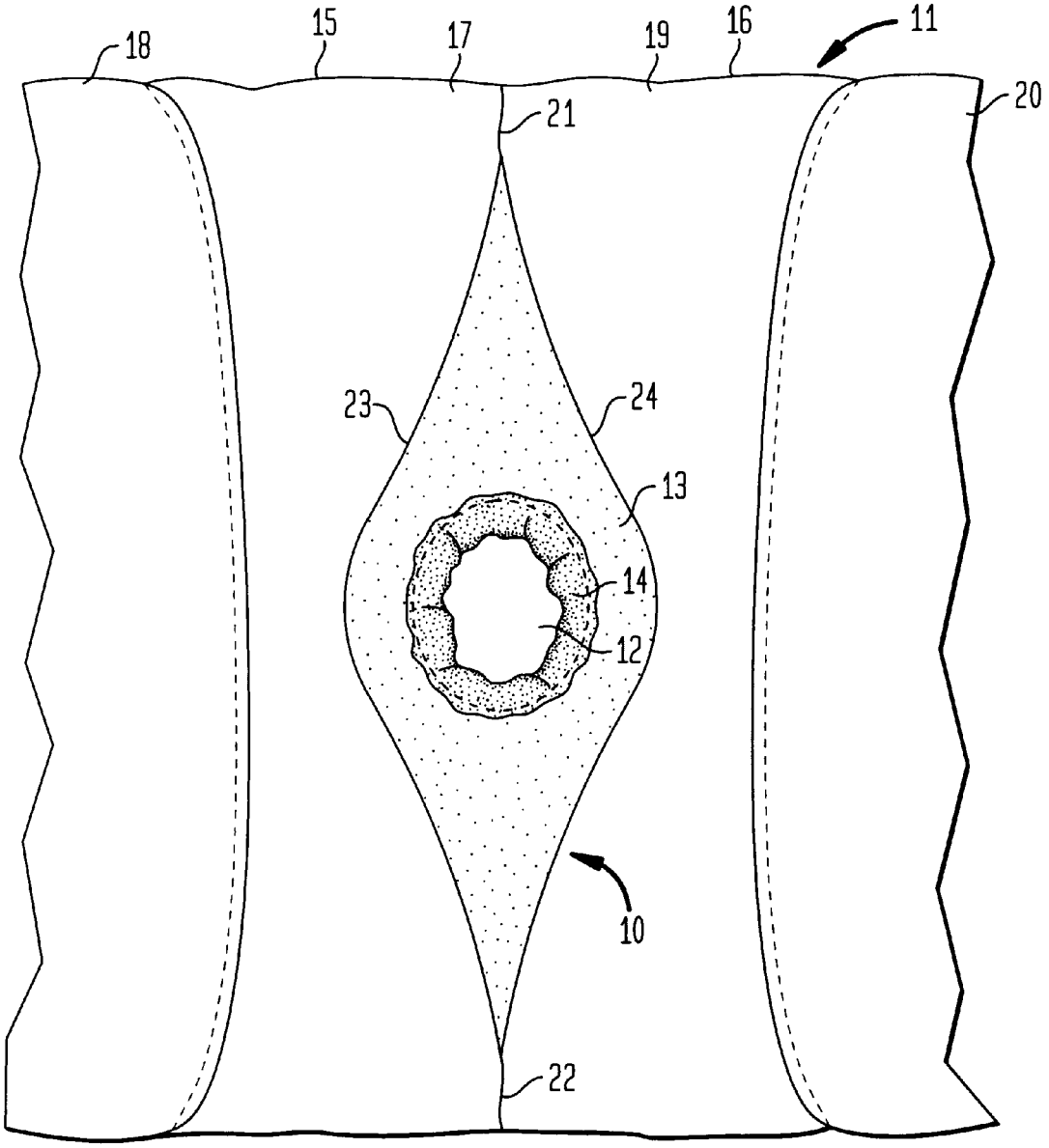
FIG. 1 illustrates a pair of pantyhose constructed in accordance with the present invention to have a highly-ventilated crotch panel with a single aperture therethrough, the edges of which are bound by elastic cotton lace.

FIG. 1 shows a highly-ventilated crotch panel 10 in a pair of pantyhose constructed in accordance with the present invention. In this embodiment, pantyhose 11 comprising first section which is a right side portion 15 having integrally knit therein a panty portion 17 and a sheerer leg portion 18 and an equivalent second section which is left side portion 16 with panty portion 19 and leg portion 20. Side portions 15 and 16 are conventionally sewn together by the front seam 21 and back seam 22. The upper terminus of right side portion and left side portion define a waistband (not shown in this figure). A crotch panel 10 is sewn to the right side portion and the left side portion by seams 23 and 24 at a point intermediate of the leg portions.

In this embodiment, crotch panel 10 has a single aperture 12 extending completely through the main body portion 13 of the crotch panel. The edges of aperture 12 (not shown) are bound by elastic lace 14. The main body portion of crotch panel 10 may comprise a single layer of stretchable knit cotton, or other material, which is preferably moisture absorbent. In certain preferred embodiments, the main body portion 13 of the crotch panel is itself loosely woven so as to provide additional ventilation. The diameter of aperture 12, which in this embodiment is circular, is approximately one-half of the total width of the main body portion 13 of the crotch panel.

Figure 2:
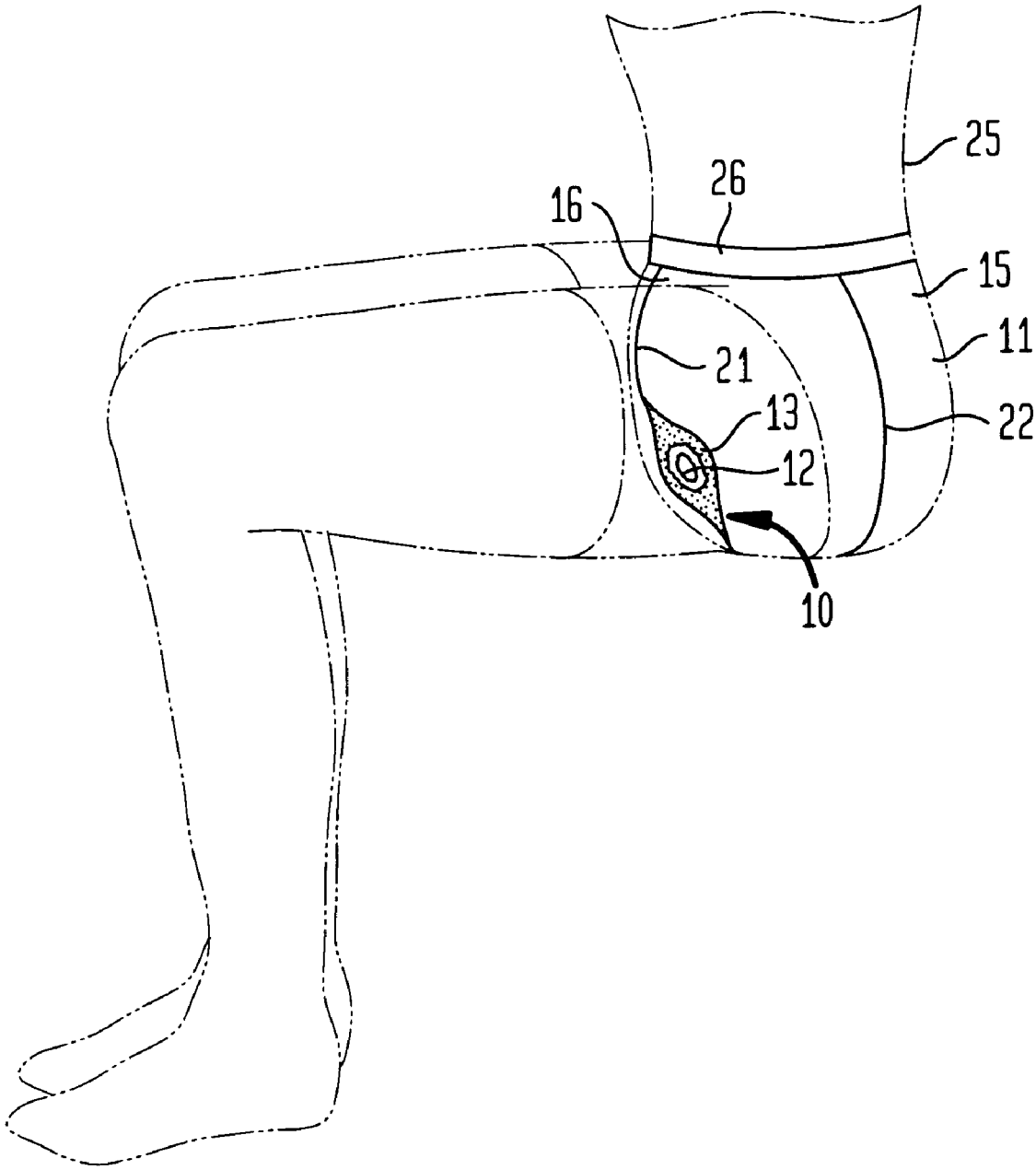
FIG. 2 is an illustration of the pantyhose of FIG. 1, in use, or as worn on a human body.

FIG. 2 illustrates the pantyhose of FIG. 1 in use, or as worn by a human body. Reference numerals which denote similar elements to those described with respect to FIG. 1 remain the same for this figure. In this figure, a seated female body 25, from the torso to the ankles, is shown wearing pantyhose 11 as illustrated in FIG. 1. Right side portion 15 covers the right abdomen, buttocks, and leg whereas left side portion 16 covers the left abdomen, buttocks and leg. Seam 22 extends from the rear of the main body portion 13 of crotch portion 10 to waistband 26. Similarly, front seam 21, shown in phantom, extends from the front portion of the main body portion of crotch panel 10 to waistband 26. As illustrated in FIG. 2, the opening in the main body portion of the crotch panel, in this case, aperture 12 in crotch panel 10, is situated so as to overlie the areas of the anatomy where ventilation and light would have the most beneficial application.

Figure 3:
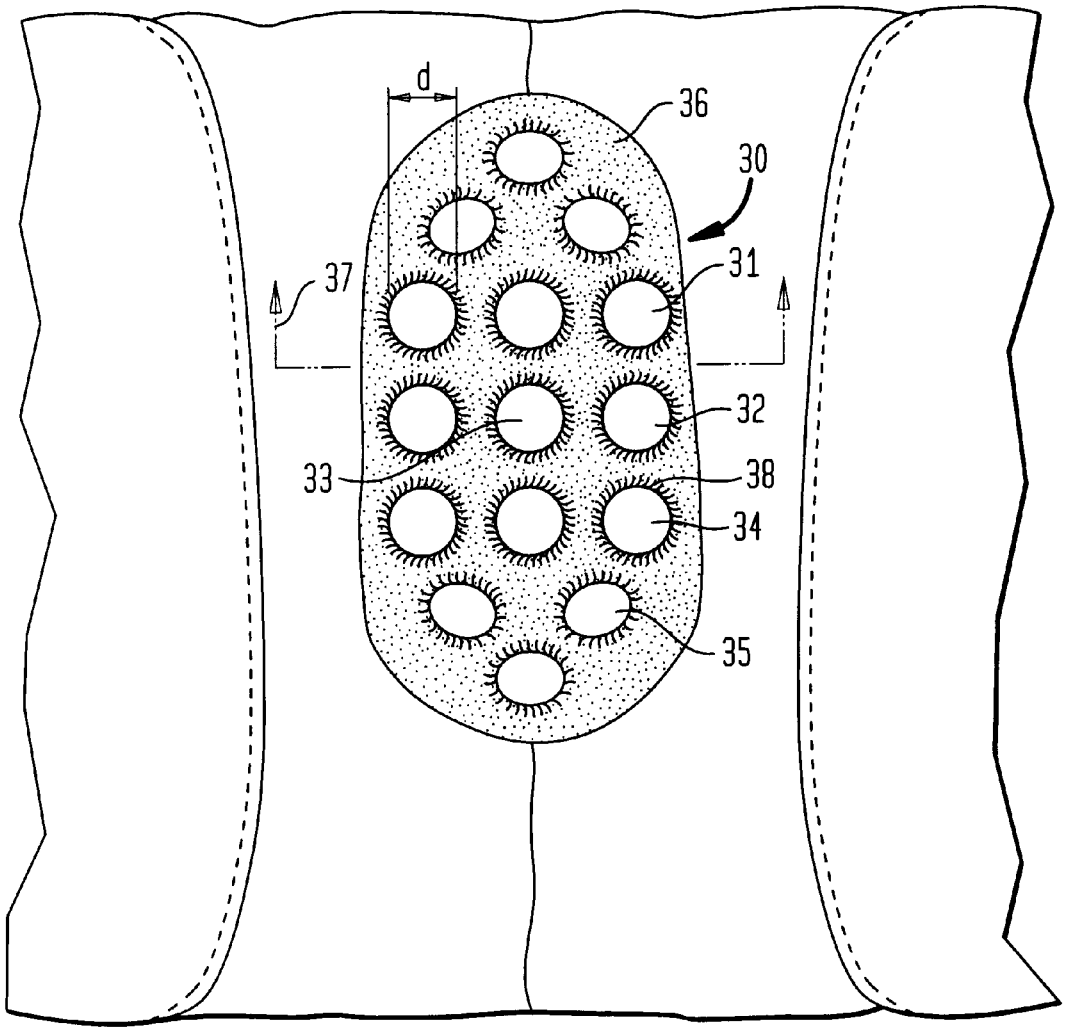
FIG. 3 illustrates another embodiment of the invention wherein the crotch panel of a pair of pantyhose is provided with multiple large diameter apertures.

In an alternative embodiment, shown in FIG. 3, the crotch panel 30 of a pair of pantyhose is provided with multiple large diameter apertures 31–35, for example, in the main body portion 36 of crotch panel 30. The open work created by apertures 31–35 may define a pattern or be random. As shown in FIG. 3, the large diameter apertures define a pattern which covers the entire main body portion 36 of crotch panel 30. However, the openwork pattern can be placed on the main body of the crotch panel so that it overlies only in those areas which, in a normally seated position, would benefit most from the exposure to light and air.

As shown in FIG. 3, the circular apertures 31–35 each have a diameter (d) which is roughly ¼ of the width of the main body of the crotch panel 36 taken along line 37. Of course, these dimensions are merely illustrative and other dimensions and configurations can be devised by a person of ordinary skill in the art in keeping with the principles of the invention, namely, the openings should be large enough to permit light and air to contact the vaginal area but not so large as to create binding and/or the uncomfortable feeling of too much exposure.

A further advantage is illustrated in FIG. 3. Crotch panel 30 comprises a main body portion 36 which may be an absorbent knit panel. The apertures 31–35 are bound around their perimeter, to prevent fraying, with thread, illustratively as shown at reference numeral 38, that absorbs moisture and/or wicks moisture away from the aperture perimeter and into the surrounding main body portion 36 wherein it dissipates and evaporates. Of course, the aperture in the embodiment of FIG. 1, which is shown surrounded by lace, can also be bound in a similar manner by thread or any other known means, such as an absorbent, flexible bias binding.

Figure 4:
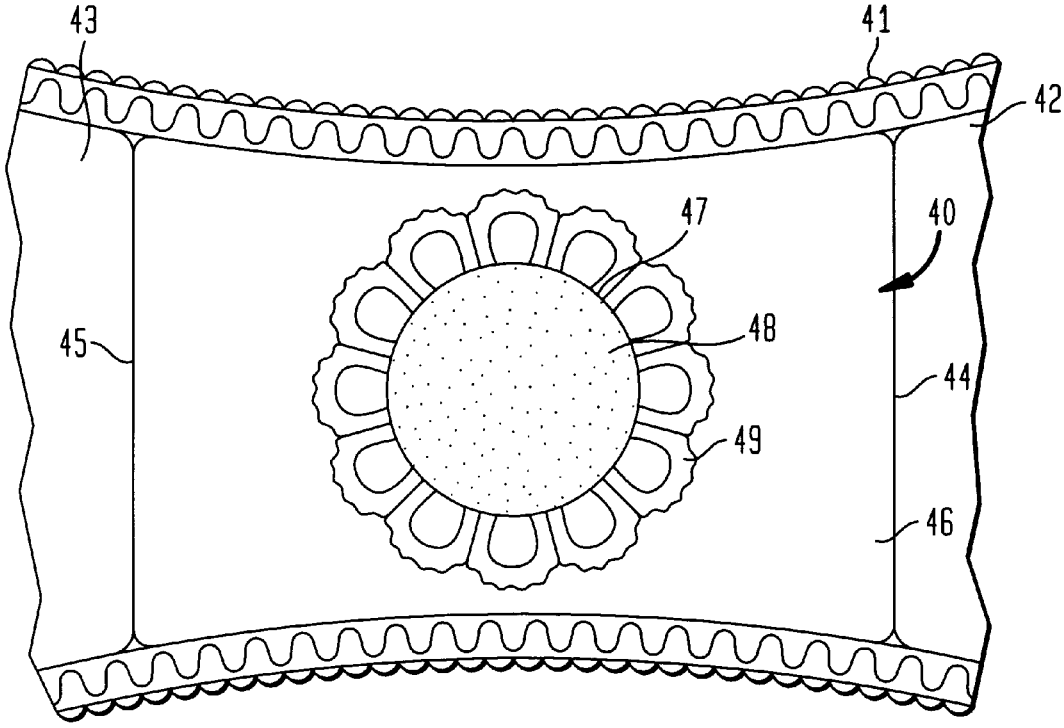
FIG. 4 illustrates an alternative embodiment of the invention wherein the aperture in the crotch panel of a pair of panties constructed in accordance with the invention is covered with a modesty panel.

In yet another embodiment of the invention, the cut-work comprising the aperture, or apertures, may be covered with a modesty panel, which, in some embodiments, is an open-weave mesh. FIG. 4 illustrates this embodiment in the form of a panty. As shown in FIG. 4, panty 41 has a crotch panel 40 intermediate front section 42 and back section 43. Front section 42 and back section 43 are conventionally joined to form a waist opening (not shown) and a two leg openings. Although panties 41 are shown to be joined by seams, such as seams 44 and 45, which join the main body portion 46 of crotch panel 40 to the front and back sections, it is to be understood that all of the major components (42, 42, and 46) of panty 41 could be integrally knitted or woven. Main body portion 46 of crotch panel 40, which may be of the same material as front and back sections 42 and 43 or of another material, preferably a water absorbent and breathable material, has an aperture extending completely therethrough, defined by perimeter 47. In this embodiment, the aperture is covered by modesty panel 48 which comprises a single layer of open-weave mesh. The modesty panel 48 is attached to main body portion 46 by stitching around the perimeter 47 through a decorative, elastic lace trim 49.

Although modesty panel 48 is shown as an open-weave mesh, which may be an absorbent material, in the embodiment of FIG. 4, it is to be understood that other materials, such as a lightweight, small denier, woven cotton, can be utilized provided that the modesty panel receives and distributes moisture for evaporation and/or permits an adequate flow of air.

Figure 5:
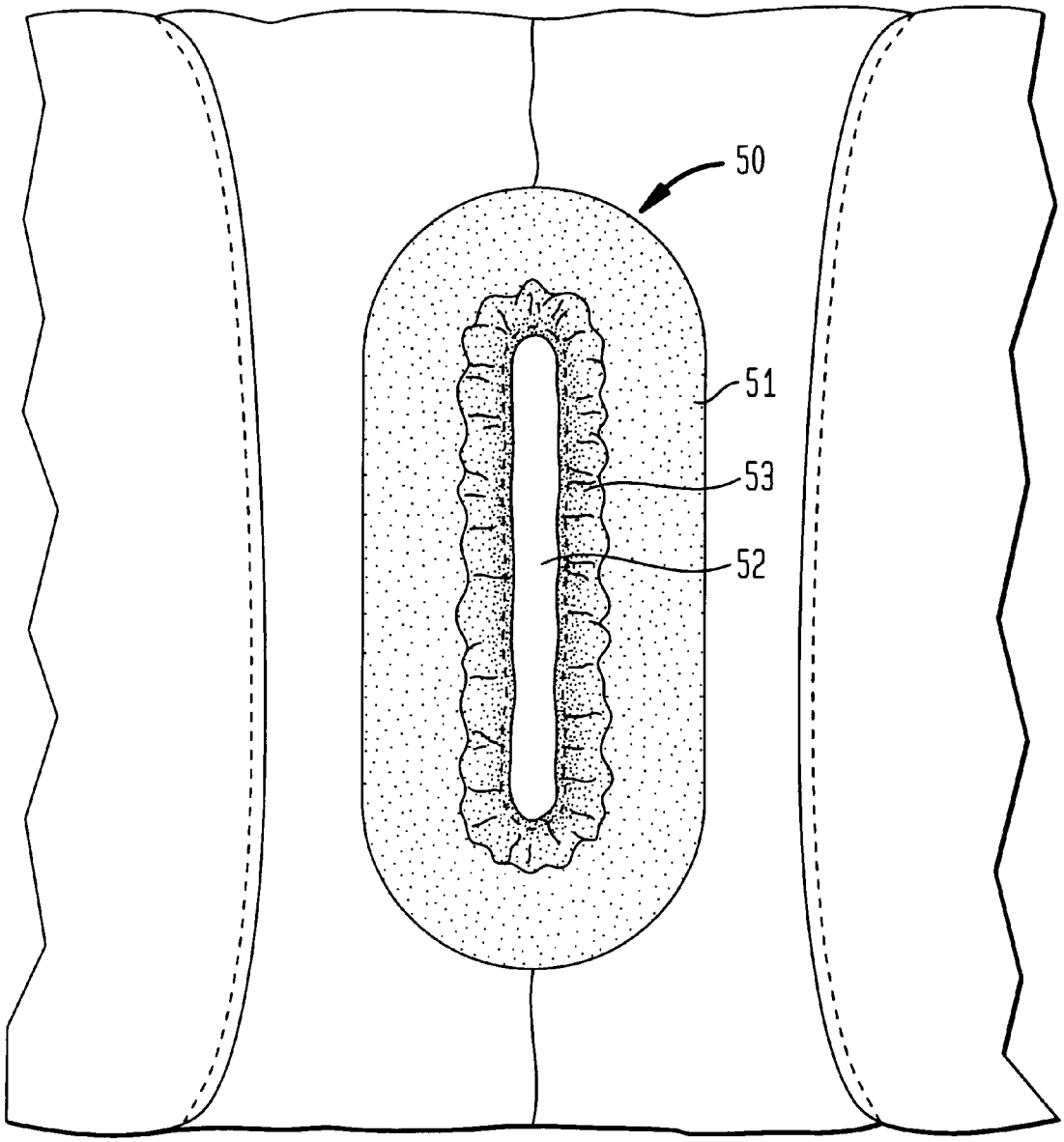
FIG. 5 illustrates a still further embodiment of the invention wherein the crotch panel of a pair of pantyhose comprises an open-weave mesh having an elongate aperture therein.

In a still further illustrative embodiment, shown in FIG. 5, crotch panel 50 comprises, as a main body portion 51, a single layer of open weave cotton mesh, which has an elongated aperture52 extending completely therethrough. Lace trim 53 binds aperture 51. In this embodiment, the length of the elongated aperture is approximately one-half of the longest lengthwise dimension of the main body portion 51 of crotch panel 50. The width is approximately one third of the width of the main body portion 51.

Of course, a further advantage of the panty and/or pantyhose embodiments described herein is that appeal to a women's sense of beauty and sensuality, in addition to being practical and healthful.

Although the invention has been described in terms of specific embodiments and applications, persons skilled in the art can, in light of this teaching, generate additional embodiments without exceeding the scope or departing from the spirit of the claimed invention. For example, the principles of the invention can be applied to any undergarment, such girdles or leotards or tights. Accordingly, it is to be understood that the drawing and description in this disclosure are proffered to facilitate comprehension of the invention, and should not be construed to limit the scope thereof.

What is claimed is:

1. An undergarment of the type having a panty portion having a first section, a second section and a crotch panel, the panty portion being conventionally joined to define a waist opening and two leg openings with the crotch panel intermediate the leg openings, wherein the crotch panel has a main body portion having an aperture extending therethrough which is dimensioned to range from about one-half to one-third of the dimensions of the crotch panel to permit free flow of air and light.

2. The undergarment of claim 1 wherein the main body portion of the crotch panel is a single layer of water-absorbent material.

3. The undergarment of claim 1 wherein the aperture is a circular and has a diameter of approximately one half the width of the main body portion of the crotch panel.

4. The undergarment of claim 1 further comprising an absorbent, stretchable lace or trim binding the edges of the aperture.

5. The undergarment of claim 1 wherein the edges of the aperture is bound by stitching which is absorbent.

6. The undergarment of claim 1 wherein the aperture is covered with a modesty panel.

7. The undergarment of claim 6 wherein modesty panel is a single-layer open weave mesh.

8. The undergarment of claim 6 wherein the modesty panel is a thin, lightweight loosely woven cotton.

9. An undergarment of the type having a panty portion having a first section, a second section and a crotch panel, the panty portion being conventionally joined to define a waist opening and two leg openings with the crotch panel intermediate the leg openings, wherein the crotch panel comprises:

a single-layer absorbent main body portion;

at least one aperture extending completely through a central portion of the main body portion, the at least one aperture being dimensioned not to exceed, in any direction, individually or cumulatively more than one half of the dimension of the crotch panel in that direction, to permit free flow of air and light; and an absorbent trim binding the edges of the at least one aperture.

10. The undergarment of claim 9 further comprising a modesty panel overlying the at least one aperture.

11. The undergarment of claim 9 wherein the trim is an elasticized lace.

12. An undergarment of the type having a panty portion having a first section, a second section and a crotch panel, the panty portion being conventionally joined to define a waist opening and two leg openings with the crotch panel intermediate the leg openings, wherein the crotch panel has a main body portion having a plurality of large diameter apertures having dimensions which, in any direction, do not exceed cumulatively more than one half of the dimension of the crotch panel in that direction, to permit free flow of air and light.

13. The undergarment of claim 12 further comprising an absorbent trim binding the edges of the at least one aperture.

14. The undergarment of claim 13 wherein the absorbent trim is stretchable lace which is absorbent.

15. The undergarment of claim 13 wherein the trim is absorbent stitching.

16. The undergarment of claim 12 wherein the aperture s are covered with a modesty panel.

17. The undergarment of claim 16 wherein the modesty panel is a single-layer open weave mesh.

18. The undergarment of claim 16 wherein the modesty panel is a thin, lightweight loosely woven cotton.

* * * * *

UNITED STATES PATENT AND TRADEMARK OFFICE

CERTIFICATE OF CORRECTION

PATENT NO. : 6,209,143 B1
DATED : April 3, 2001
INVENTOR(S) : Shèron Hancock

It is certified that error appears in the above-identified patent and that said Letters Patent is hereby corrected as shown below:

Column 6,
Line 31, after "light" insert -- the aperture being bound by absorbent trim --;
Line 35, delete "a";
Line 38, after "claim 1" insert -- wherein the absorbent trim is --;
Line 38, delete "further comprising"; and
Line 44, after "a" insert -- single-layer --.

Signed and Sealed this

Tenth Day of September, 2002

*Attest:*

*Attesting Officer*

JAMES E. ROGAN
*Director of the United States Patent and Trademark Office*